United States Patent [19]

Byers

[11] 4,334,757

[45] Jun. 15, 1982

[54] DIFFUSION TRANSFER SHEET REGISTRATION

[76] Inventor: Thomas L. Byers, P.O. Box 26624, Oklahoma City, Okla. 73126

[21] Appl. No.: 183,135

[22] Filed: Sep. 2, 1980

[51] Int. Cl.[3] ..... G03D 3/08

[52] U.S. Cl. ..... 354/301; 354/339

[58] Field of Search ..... 354/84, 85, 86, 301, 354/302, 303, 305, 338, 339; 355/27, 100, 106

[56] References Cited

U.S. PATENT DOCUMENTS

| | | | |
|---|---|---|---|
| 2,786,401 | 3/1957 | Briggs et al. | 354/301 |
| 2,894,440 | 7/1959 | Boger | 354/302 |
| 3,062,124 | 11/1962 | Lassig | 354/302 |
| 3,136,238 | 6/1964 | Corona | 354/302 |
| 3,216,341 | 11/1965 | Burnett | 355/100 |

FOREIGN PATENT DOCUMENTS

| | | | |
|---|---|---|---|
| 1150282 | 11/1961 | Fed. Rep. of Germany | 354/302 |
| 2043693 | 3/1972 | Fed. Rep. of Germany | 354/302 |

*Primary Examiner*—Joseph W. Hartary
*Assistant Examiner*—Alan Mathews
*Attorney, Agent, or Firm*—Robert K. Rhea

[57] ABSTRACT

A generally planar T-shaped separator replaces the conventional separator in a diffusion transfer processor. The bar of the T-shape projects forwardly in spaced parallel relation with respect to the forward side of a diffusion transfer processor with the stem of the T-shape centrally projecting into the chemical bath of the processor. This permits register pin receiving end portions of a light sensitive negative sheet and receiver sheet, disposed in superposed relation and respectively under and overlying the T-bar of the separator, to be registered together with pins at their respective corner portions facing the processor. The two sheets, joined by the pins to maintain registration, are then moved through the processor while the stem of the separator maintains a spacing between the two sheets while in the chemical bath to allow the chemical bath to flow between the sheets for proper development.

7 Claims, 8 Drawing Figures

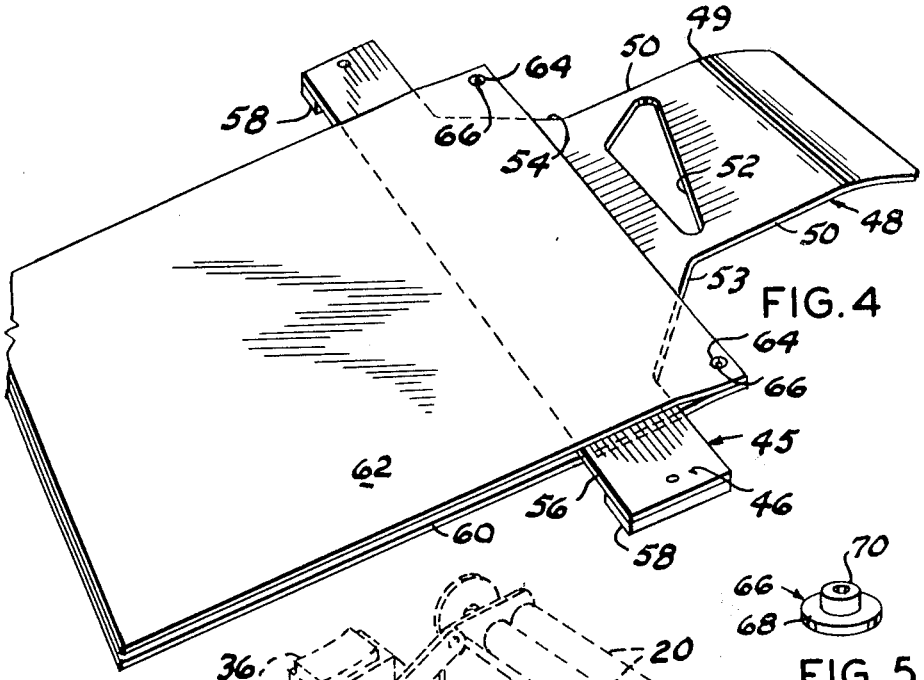
FIG. 4
FIG. 5
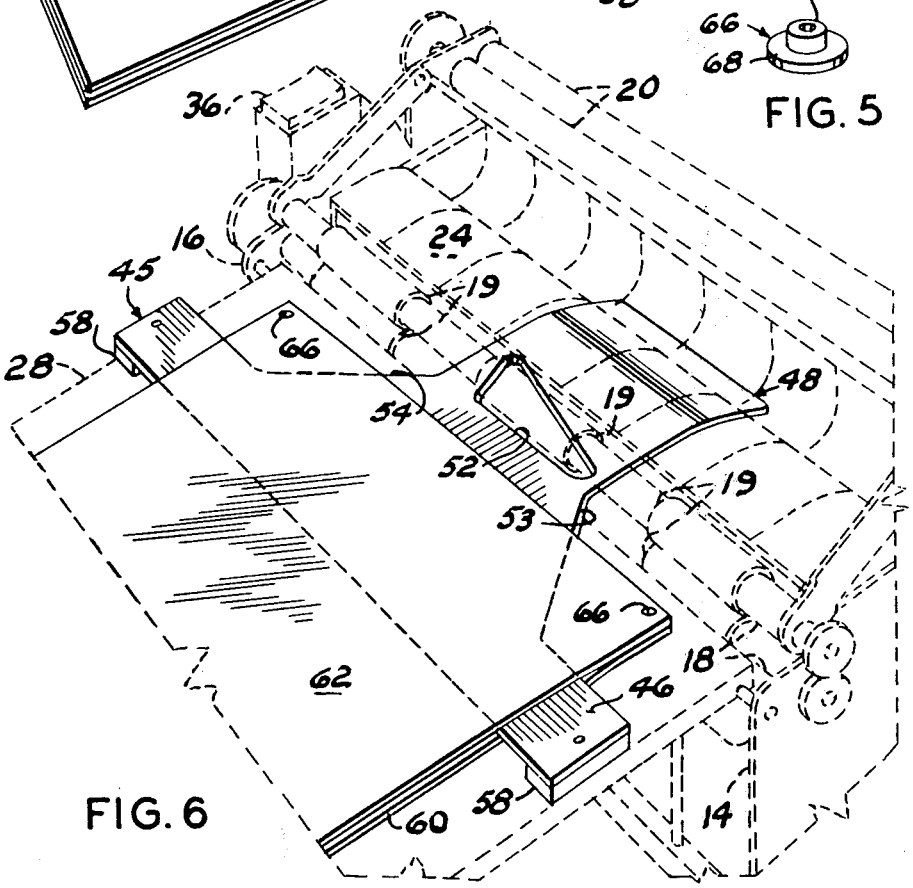
FIG. 6

DIFFUSION TRANSFER SHEET REGISTRATION

CROSS REFERENCE TO RELATED APPLICATION

This application is a national application of an application filed by me in the U.S. Patent and Trademark Office on May 9, 1980, Ser. No. PCT/US80/00560, entitled Diffusion Transfer Sheet Registration.

BACKGROUND OF THE INVENTION

1. Field of the Invention

The present invention relates to diffusion transfer processors and more particularly to a sheet separator permitting accurate registration of a light sensitive sheet of film or paper having an image exposed upon it (hereinafter called "negative sheet") and a non-sensitive image receiving sheet of film or paper (hereinafter called "receiver sheet") prior to, during and after being processed.

A diffusion transfer processor transfers a graphic image from an exposed negative sheet to a receiver sheet by passing the superposed negative sheet and receiver sheet through a bath of chemical activator or developer in which the negative sheet and receiver sheet are temporarily separated one from the other as they move through a tray containing the chemical bath and are rejoined in face to face contiguous contact by a pair of squeegee rollers retaining excess activator within the tray.

Conventional diffusion transfer processing units do not provide for pin registration of the negative sheet with the receiving sheet while the negative sheet and receiving sheet are being processed for the reason the negative sheet and receiving sheet must be disposed on the respective upper and lower surfaces of a planar separator when entering the chemical bath to insure contiguous coating of the chemical activator on the emulsion face surface of the negative sheet and receiver sheet. It is desirable when preparing graphic images, to be later reproduced for printing, to register a plurality of supplemental images on a plurality of receiving sheets from which printing plates can be exposed in register for color printing in different colors, or the like. This invention provides a negative sheet and receiver sheet separator permitting such registration.

2. Description of the Prior Art

Diffusion transfer processor units presently used comprise a table top unit including a tray containing a bath of chemical activator into which one edge of a negative sheet and receiver sheet are manually inserted on respective upper and lower surfaces of a planar separator. At least one pair of negative sheet and receiver sheet advancing rollers, driven by an electric motor, advances the negative sheet and receiver sheet through the activator bath. The planar separator, being at least coextensive with the negative and receiver sheet widths, prevents pin registration of the negative sheet with the receiver sheet while being processed by the apparatus. At least one conventional diffusion transfer processor provides a negative sheet and receiver sheet horizontal shelf adjacent the entrance opening supported by the shelf to permit alignment of one edge surface of the respective negative sheet and receiver sheet but does not permit repeated accurate registration of the negative sheets and receiver sheets while passing through the processor.

SUMMARY OF THE INVENTION

The present invention permits accurate registration of a negative sheet with a receiver sheet when processed by a diffusion transfer processing apparatus. This is accomplished by providing a negative sheet and receiver sheet separator which replaces the generally rectangular planar separator of conventional diffusion transfer processing apparatus. In the preferred embodiment, the improved separator is generally planar T-shaped with the bar of the T-shape overlying a shelf or platform adjacent the sheet entrance opening of the processor and parallel with the longitudinal axis of its rollers with the stem of the T-shape projecting into a chemical activator containing tray of the machine. This permits the negative sheet and receiver sheet to be manually disposed at one end portion in superposed relation over and below the bar portion of the separator. The respective corner portions of the negative sheet and receiver sheet, facing the apparatus, after having been previously punched with registration pin holes, are joined together by low profile registration pins capable of passing through the processor rollers. The negative sheet and receiver sheet are then advanced into and through the processing apparatus in a conventional manner with the registration pins being removed after the predetermined development time. Other negative sheets and receiver sheets, having been similarly punched with registration pin holes, may be processed in a like manner for subsequent accurate registration of one image bearing receiver sheet with respect to another.

Images from two or more register pin punched negative sheets may be transferred onto a single register pin punched receiver sheet in accurate register for the purpose of building composite graphic images on a single receiver sheet or for proofing prepared separations in color or black and white.

BRIEF DESCRIPTION OF THE DRAWINGS

FIG. 4 is a perspective view of the separator of FIG. 3 illustrating the relative position of a negative sheet and receiver sheet when positioned on the separator and pin registered with each other;

FIG. 5 is a perspective view, to a larger scale, of one of the registration pins, per se;

FIG. 6 is a fragmentary perspective view, similar to FIG. 4, to a different scale, illustrating the relative position of the improved separator and registered negative and receiver sheets with respect to the diffusion transfer processor of FIG. 1, the latter being shown by dotted lines;

DESCRIPTION OF THE PREFERRED EMBODIMENTS

Figure 1:
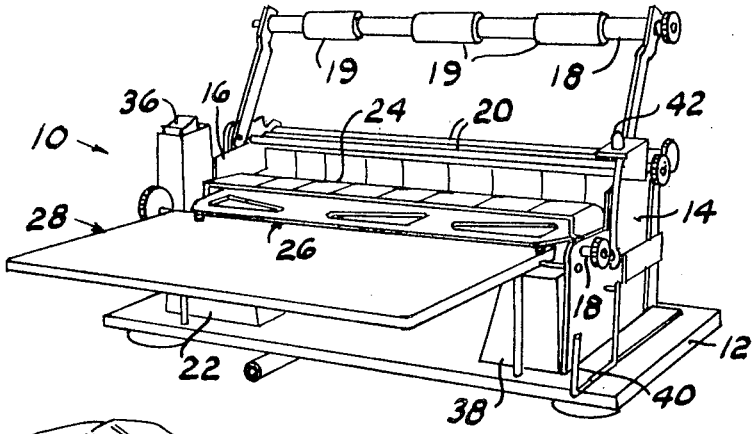
FIG.1 (PRIOR ART)
FIG. 1 is a perspective view of a conventional diffusion transfer processor with the cover removed and one front drive roller in lifted position exposing the negative sheet and receiver sheet separator.

Like characters of reference designate like parts in those figures of the drawings in which they occur.

Figure 2:
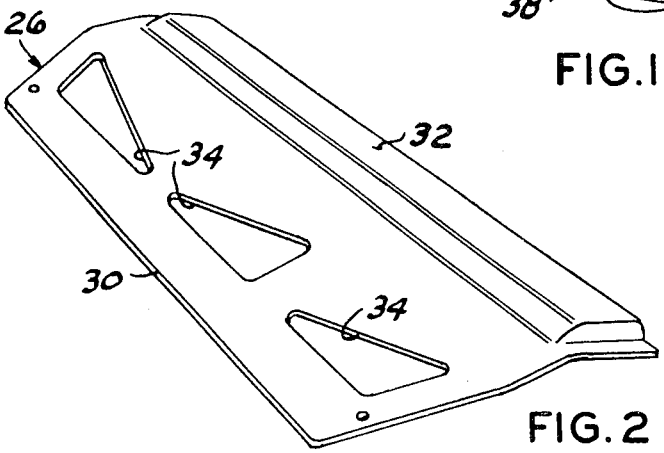
FIG. 2 (PRIOR ART)
FIG. 2 is a perspective view, to a larger scale, of the separator when removed from the processor of FIG. 1.

In the drawings:

Referring more particularly to FIGS. 1 and 2, the reference numeral 10 indicates a conventional diffusion transfer processor apparatus model No. P1400, presently marketed by nuArc Company, Inc., 4100 West Grand Avenue, Chicago, Ill. 60651. The apparatus 10 comprises a horizontal table base 12 supporting a pair of upright walls 14 and 16 in turn supporting a pair of drive rollers 18 at its forward side, having longitudinally spaced diametrically enlarged portions 19 intermediate their ends and a pair of squeegee rollers 20 adjacent their rearward upper limit with each pair of rollers driven by a motor surrounded by a housing 22. The end walls 14 and 16 support a guide 24 overlying a tray, not shown, containing a bath of chemical activator or developer, not shown, with a separator 26 interposed between the tray and guide in sandwich form. The forward or front side of the machine supports a horizontal platform or shelf 28 for supporting paper or sheets, as hereinafter explained.

The separator 26 is generally planar and substantially coextensive with the spacing between the walls 14 and 16 with its forward edge surface 30 projecting horizontally forward of the apparatus in a plane between the drive rollers 18 with its rearward edge portion 32 transversely turned downwardly from the plane of its forward edge for entering the fluid bath in the spacing between the guide 24 and underlying tray. Adjacent its forward edge, the separator 26 is provided with a plurality, three in the example shown, of longitudinally aligned apertures 34 loosely surrounding the drive roller diametrically enlarged portions 19 gripping superposed sheets being moved through the apparatus. The apparatus 10 further includes an on/off switch 36 for starting the motor, a timer contained by a housing 38 and activated by a lever 40 and a time interval lamp 42.

The above description forms no part of the invention other than to set forth the combination employed in which the conventional separator 26 is removed and not used.

Figure 3:
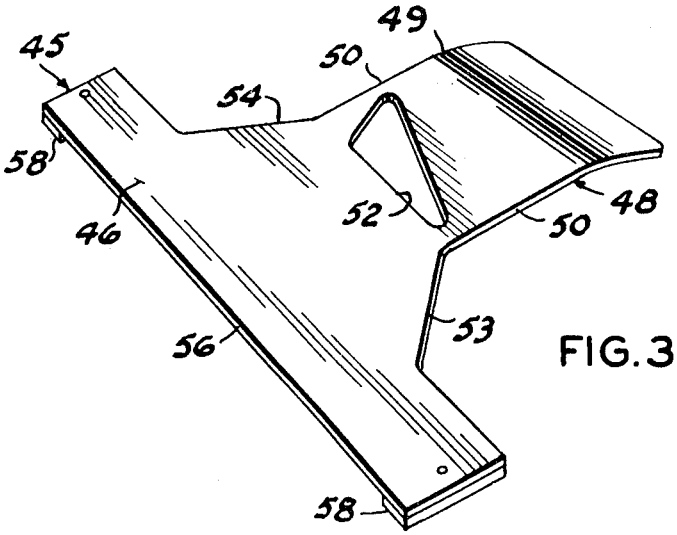
FIG. 3 is a perspective view of one embodiment of the improved separator, per se.

The reference numeral 45 (FIG. 3) illustrates one embodiment of the improved separator, per se, comprising a section of thin sheetlike material having a generally T-shaped configuration characterized by a bar portion 46 and a tongue or stem portion 48. The length of the bar portion 46 is substantially coextensive with the length of the drive rollers 18 and overlies the shelf 28 with its longitudinal axis parallel with the longitudinal axis of the drive rollers 18. The width of the bar portion 46 is a matter of choice but is preferably relatively narrow when compared with its length. The transverse width of the tongue or stem portion 48 is relatively narrow when compared with the length of the bar portion 46 being slightly greater than the length of the centermost diametrically enlarged portion 19 of the drive rollers and is characterized by parallel side edges 50 and a transverse vertical aperture 52 therebetween which nests the centermost enlarged portion 19 of the drive rollers. The free end portion of the stem 48 is turned downwardly, as at 49, for entering the fluid bath below the tray guide 24. The stem side edges 50 diverge from the position of the aperture 52 toward the adjacent side edge of the bar portion, as at 53 and 54, with the spacing between these diverging edges 53 and 54, at their juncture with the bar portion 46, being substantially less than the length of the bar portion and less than the transverse width of negatives or receiving sheets to be registered prior to processing, as presently explained.

The spacing between the separator aperture 52 and forward edge 56 of the bar portion is a matter of choice and preferably a distance at least greater than the transverse width of the stem 48 to allow ample space between the bar 46 and forward side of the apparatus 10 for registering a negative sheet and receiver sheet, as presently explained.

The respective end portions of the T-bar 46 overlie and are secured to a pair of spacers 58 having a thickness at least greater than the thickness of a negative or receiver sheet for the purposes of maintaining the separator in a plane spaced above the level of the upper surface of a supporting surface, such as the shelf 28.

Referring more particularly to FIGS. 4, 5 and 6, the separator 45 is disposed on the shelf 28, in the position illustrated by FIG. 6, wherein the respective end portions of the T-bar 46 are adjacent respective side edges of the shelf and the separator aperture 52 nesting the central enlarged portion 19 of the driving rollers 18 with the down turned end portion 49 of the tongue disposed within the fluid bath of the tray below the guide 24. The separator 45 is secured to the shelf in this position, such as by the use of tape or screws, not shown, joining the respective end portions of the T-bar 46 to adjacent side surfaces of the shelf 28. A negative sheet 60, exposed to contain a negative image to be reproduced, not shown, is placed emulsion side up, on the upper surface of the shelf 28 with one of its end portions underlying and projecting beyond the T-bar 46 toward the front side of the processor 10. An identical size receiver sheet 62, with its emulsion side down, is placed over the negative sheet 60 and the T-bar 46 with one of its end edges coinciding with the end of the negative sheet adjacent the apparatus. Prior to superposing the negative sheet 60 and receiver sheet 62, both sheets are provided, at the end portion facing the apparatus, with the register pin receiving holes 64. With the register pin holes 64 in substantial alignment, a low profile register pin 66 is placed within the aligned register pin holes 64.

The register pin 66 (FIG. 5) is conventional and is characterized by an annular flange 68 having a coaxial upstanding relatively short cylindrical portion 70 diametrically closely received by the register pin holes in a friction fit which secures the negative sheet 60 to the receiver sheet 62 at opposing corner portions of the two sheets adjacent the apparatus 10 and in the spacing between the T-bar 46 and front surface of the machine outwardly of the separator diverging edges 53 and 54. Obviously, other conventional types of register pins, not shown, may be used, if desired.

The register pin joined negative sheet 60 and receiver sheet 62 are then manually moved as a unit in a sliding action along the shelf 28 and separator 45 toward the drive rollers 18 until gripped thereby and advanced into the chemical bath. As the driving rollers 18 advance the sheets 60 and 62, the separator tongue 48 maintains a spacing or air gap between the two sheets, with the exception of the respective joined corner portions, as the sheets are advanced into and passed through the chemical bath thus insuring contiguous contact with the activator on all surfaces of the two sheets. The registered leading edges of the negative 60 and receiver 62 are guided by the tray guide 24 to the squeegee rollers 20 which, by gripping opposing surfaces of the superposed sheets, remove excess activator from the surfaces thereof and insures contiguous face to face contact of the emulsion surfaces.

After the two sheets have passed through the squeegee rollers 20 the timer is activated by manual movement of the timer lever 40 for a predetermined development time, such as 30 seconds, indicated by the timer light 42, as is conventional. Thereafter, the two sheets are manually separated one from the other and the register pins 66 removed. Additional negative and receiver sheets, similarly punched for receiving the register pins 66, may be processed in a like manner for forming registered artwork separations, or the like, for multicolor printing.

Figure 7:
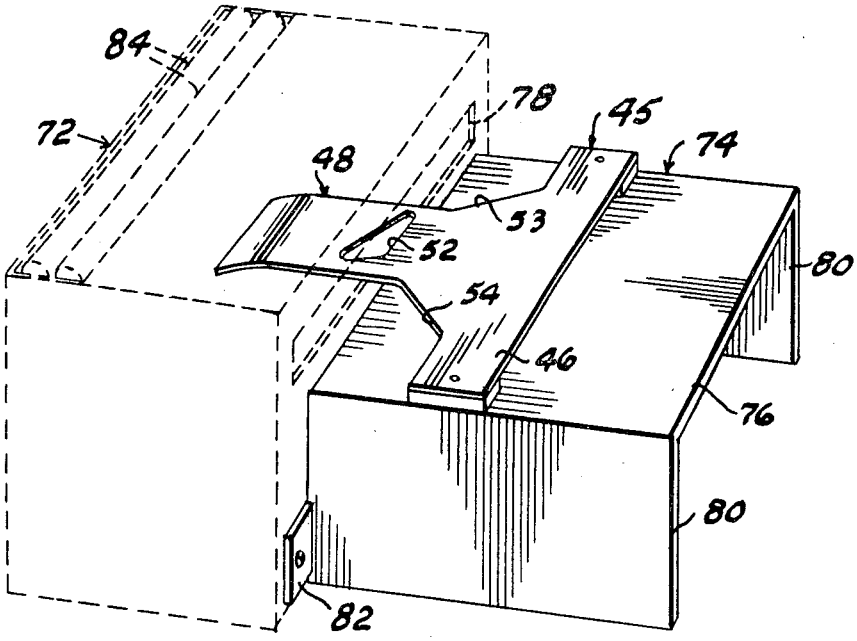
FIG. 7 is a perspective view of the improved separator of FIG. 3 and a support therefor when used with another model transfer processor, illustrated by dotted lines, lacking a sheet support shelf and front drive rollers; and, FIG. 8 is a perspective view of another embodiment of the improved separator illustrating the relative position of a negative sheet and receiving sheet when positioned on the separator and pin registered with each other.

Referring now to FIG. 7, some diffusion transfer machines, such as illustrated by dotted lines 72, are not provided with a negative sheet and receiver sheet placement shelf and in this event a rack 74 is provided for supporting the separator 45. The rack 74 is substantially inverted U-shaped in general configuration comprising a horizontally disposed bight portion 76 abutting the machine 72 adjacent and spaced below its sheet entrance opening 78 and is supported by parallel legs 80. Wings or tabs 82, only one being shown, on the respective leg 80, connect the rack to the housing of the machine. After removing the conventional separator, not shown, from the machine 72 the separator 45 is disposed on the top surface of the rack 74 and secured thereto with its tongue portion 48 extending into the machine 72 in the manner described hereinabove for the apparatus 10.

Thereafter, the negative sheet 60 and receiver sheet 62 may be processed by the machine in the manner described hereinabove. Similarly, some diffusion processor machines are not equipped with the front driving rollers and in this event the registration pin joined negative sheet and receiver sheet are manually inserted through the machine opening 78 and moved through the bath until gripped by the squeegee rollers 84.

Figure 8:
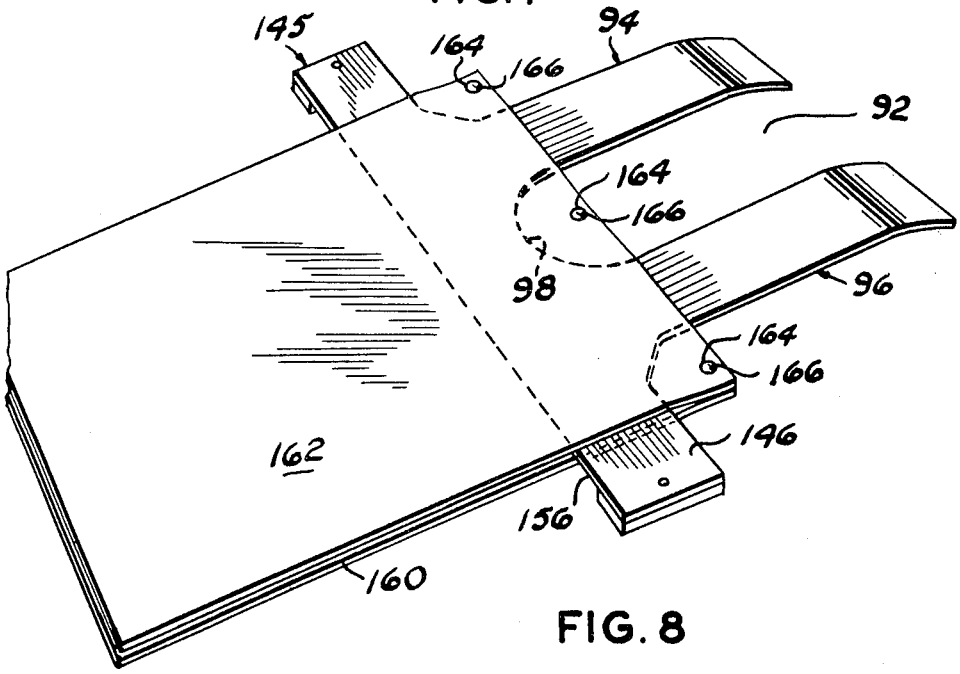

Referring to FIG. 8, the numeral 145 indicates another embodiment of the improved separator in which the stem portion of the separator is transversely widened and bifurcated by a U-shaped slot 92 to form a pair of separator stem portions 94 and 96. The width of the U-shaped slot 92 is at least equal to the length of the centermost diametrically enlarged portion 19 of the drive rollers 18 with the bight portion 98 of the U-shaped slot terminating in spaced relation, with respect to the forward side edge 156 of the separator bar portion 146, a distance equal to the transverse dimension of the bar portion. The transverse width of the respective dual stems 94 and 96 is slightly less than the spacing between any two adjacent drive roller enlarged portions 19 for the reasons presently explained. This permits the negative sheet 160 and receiver sheet 162 to be similarly punched with a plurality of registration pin holes 164, three in the example shown, and similarly disposed in respective over and underlying relation with respect to the separator bar portion 146 and adjacent end portions of the dual stems 94 and 96 for joining the leading edge portion of the two sheets by register pins 166. In use, the separator 145 is similarly disposed on the shelf 28, or rack 74, as disclosed hereinabove, with its dual stems 94 and 96 projecting into the processor 10 between the drive rollers 18 within the spacing defined by adjacent end portions of the drive roller diametrically enlarged portions 19.

Obviously the invention is susceptible to changes or alterations without defeating its practicability. Therefore, I do not wish to be confined to the preferred embodiment shown in the drawings and described herein.

I claim:

1. In combination with a diffusion transfer processor having an elongated entrance opening for admitting a pair of superposed sheets to be processed, a tray containing a chemical bath, a guide overlying the tray for guiding the sheets into and out of the chemical bath and having at least one pair of elongated rollers for progressively advancing the sheets through the processor, the improvement comprising:

a generally T-shaped sheet separator having at least one stem portion projecting, at one end, into the processor intermediate the length of the entrance opening and interposed at its innermost end portion in the chemical bath between the tray and guide, said separator having a bar portion at least coextensive with the length of the entrance opening and disposed in spaced relation outwardly of the entrance opening; and, register pin means for joining the edge portion of the sheets adjacent the processor and respectively over and underlying the bar portion on opposing sides of the stem portion.

2. The combination according to claim 1 in which said processor is provided with a planar sheet support lying in a plane parallel with the longitudinal axis of the entrance opening and in which said separator bar portion extends transversely of the support in parallel spaced relation.

3. The combination according to claim 2 in which said pair of rollers includes a pair of drive rollers disposed adjacent the entrance opening, each roller of said pair of drive rollers have a cooperating diametrically enlarged portion medially its ends, said separator stem portion being further characterized by an aperture intermediate its width and length cooperatively receiving said drive roller diametrically enlarged portion.

4. The combination according to claim 3 and further including:

a spacer interposed between each end portion of the separator bar portion and the adjacent surface of the support.

5. The combination according to claim 1 or 2 in which said pair of rollers includes a pair of drive rollers disposed adjacent the entrance opening, each roller of said pair of rollers having cooperating longitudinally spaced diametrically enlarged portions intermediate their ends, said separator stem portion being longitudinally divided to form at least two stem portions and define a slot therebetween the transverse width of the slot being at least equal with the longitudinal dimension of the drive roller diametrically enlarged portions and the transverse width of the respective stem portions being less than the spacing between the drive roller diametrically enlarged portions.

6. A method of registering an exposed negative sheet with a receiver sheet to be processed by a diffusion transfer processor having a sheet admitting opening, comprising:

(a) providing a planar T-shaped sheet separator;

(b) inserting the stem portion of said separator into the sheet admitting opening;

(c) placing a common edge portion of said negative sheet and said receiver sheet in respective under and overlying relation on the bar portion of said separator;

(d) separably joining said common edge portions of said sheets together on opposing sides of said stem portion; and, (e) moving said negative and receiver sheets as a unit, longitudinally of said stem portion, into the sheet admitting opening.

7. The method according to claim 6 in which step (d) includes:

(f) punching cooperating register pin holes in the common edge portions of said negative and receiver sheets;

(g) providing sheet joining register pins; and, (h) placing the register pins in the register pin holes.

* * * * *